US009452368B2

(12) United States Patent
Dochtermann, III

(10) Patent No.: US 9,452,368 B2
(45) Date of Patent: Sep. 27, 2016

(54) COLLAPSIBLE TOY BLOCKS

(71) Applicant: Cliff Dochtermann, III, East Patchogue, NY (US)

(72) Inventor: Cliff Dochtermann, III, East Patchogue, NY (US)

( * ) Notice: Subject to any disclaimer, the term of this patent is extended or adjusted under 35 U.S.C. 154(b) by 27 days.

(21) Appl. No.: 14/667,891

(22) Filed: Mar. 25, 2015

(65) Prior Publication Data

US 2015/0196852 A1 Jul. 16, 2015

Related U.S. Application Data

(62) Division of application No. 13/586,616, filed on Aug. 15, 2012, now Pat. No. 9,011,193.

(60) Provisional application No. 61/523,448, filed on Aug. 15, 2011.

(51) Int. Cl.
*A63H 33/04* (2006.01)
*A63H 33/00* (2006.01)

(52) U.S. Cl.
CPC ..... *A63H 33/04* (2013.01); *A63H 33/008* (2013.01); *A63H 33/042* (2013.01)

(58) Field of Classification Search
CPC .... A63H 33/04; A63H 33/048; A63H 33/06; B65D 83/0817
See application file for complete search history.

(56) References Cited

U.S. PATENT DOCUMENTS

| | | | | |
|---|---|---|---|---|
| 4,243,153 | A * | 1/1981 | Mitchell | B65G 1/07 221/279 |
| 4,875,681 | A * | 10/1989 | Ofir | A63F 9/088 273/155 |
| 5,395,279 | A * | 3/1995 | McCann | A63H 33/00 446/487 |
| 6,568,981 | B1 * | 5/2003 | Chang | A63H 33/048 24/306 |
| 8,226,451 | B2 * | 7/2012 | Zheng | A63B 9/00 273/237 |
| 2005/0136793 | A1 * | 6/2005 | Strunk | A47D 15/003 446/487 |
| 2009/0298385 | A1 * | 12/2009 | Brinckerhoff | A63H 33/008 446/487 |

* cited by examiner

*Primary Examiner* — John Ricci
(74) *Attorney, Agent, or Firm* — Polsinelli PC

(57) ABSTRACT

A collapsible and expandable children's toy building block is described. The toy blocks may be made in various sizes and shapes. The toy block includes an internal frame. A cover is positioned over the internal frame to form the toy block. The toy block converts from a collapsed position to an expanded position, and the toy block converts from the expanded position back to the collapsed position.

24 Claims, 6 Drawing Sheets

COLLAPSIBLE TOY BLOCKS

CROSS REFERENCE TO RELATED APPLICATION

This application is a divisional of U.S. patent application Ser. No. 13/586,616, filed Aug. 15, 2012, which claims the benefit of U.S. Provisional Patent Application No. 61/523,448, filed Aug. 15, 2011, which are hereby incorporated by reference in their entireties.

FIELD OF INVENTION

The present invention relates to collapsible toy blocks.

BACKGROUND OF INVENTION

Existing toy blocks for children in include cardboard box blocks. These cardboard box blocks fold to a block shape. However, these cardboard box blocks are not designed to be flattened to a storage position. Once the cardboard box blocks have been folded to the block shape, it is difficult to flatten such cardboard box blocks back to their original flattened shape. As such, the existing cardboard blocks require much storage space when not being played with.

Children have long enjoyed fort building. Children often use pillows, blankets, couch cushions, etc. These items provide limited functionality and design choice. These items are bulky and difficult to clean up and provide minimum educational value.

SUMMARY OF INVENTION

Collapsible toy building blocks for children are described. The toy blocks may be made in various sizes and shapes. The toy blocks are constructed with an internal frame or skeleton. The internal frame or skeleton is covered with a covering of a stretchable material. The toy blocks are well suited for building forts and other play structures. The toy blocks are sized such that children may construct forts and other play structures of a dimension that the children may actually play inside or within the forts and other play structures.

The covering may be printed with colors, numberings, letters, pictures or parts of pictures, designs, patterns, etc. on any portion or all of the covering. These colors, numbers, letters, etc. may be used as an educational component to teach letter and number recognition. The designs may be used to assist in creating a particular fort design or puzzle, i.e., the child follows instructions by letter, color, number, etc. to create a particular fort or puzzle effect. For example, each block may form a small part of a larger picture.

The toy blocks may include fasteners, such as hook and loop fasteners, attached to various points on the covering, which allows the toy blocks to temporarily attach to each other to assist in creating structures, such as forts.

The combination of the internal frame and the covering material operate together to provide and maintain the toy block's shape, which is the natural or relaxed position or shape. However, when pressure is applied to the toy block, the internal frame and the cover, of stretchable material, allow the toy block to compress down into a flat position. Conversely, when pressure is removed from the toy block, the design of the toy block will allow it to return to its natural state as a block, i.e., the flattened block springs back or pops back to the expanded shape.

The flattened position of the toy block allows it to be stored and put away, such as, within a storage unit that is designed to hold multiple compressed blocks in a space saving manor. The storage unit houses multiple compressed blocks of various shapes and sizes. The storage unit holds and organizes multiple blocks in an efficient manner when the toy blocks are not in use. The storage unit may have the capacity to hold more than one complete set of blocks.

The toy blocks may be provided with coverings or material to go over the top or sides of the toy blocks to create a roof, ceiling, windows, doors, etc. The material will have the tendency to cling to the toy blocks or structure. The material may also be provided with fasteners to attach to the toy blocks.

The toy blocks may be used by children to build forts, playhouses, and the like. The toy blocks also include an educational aspect with the numbers, letters, and puzzle design. The toy blocks provide an innovative way for children to build forts. The toy blocks encourage imagination and enhance educational development.

In one aspect, a toy block is described. The toy block includes an internal frame. A cover is positioned over the internal frame to form the toy block. The toy block converts from a collapsed position to an expanded position. The toy block converts from the expanded position back to the collapsed position.

In another aspect, a toy block is described. The toy block includes a first frame member and a second frame member. A plurality of vertical supports pivotally connect to the first frame member, and the plurality of vertical supports pivotally connect to the second frame member. A cover covers the first frame member, the second frame member, and the plurality of vertical supports. The toy block comprises a flattened position and a block position.

In another aspect, a toy block play system is described. The toy block play system includes a plurality of toy blocks. The toy blocks comprise a collapsed position and an expanded position. The toy block play system includes a storage unit to store the plurality of toy blocks. The storage unit includes a first storage section and a second storage section. The first storage section includes a first compression plate to hold the toy blocks in the first storage section. The second storage section includes a second compression plate to hold the toy blocks in the second storage section.

DETAILED DESCRIPTION OF INVENTION

Figure 2:
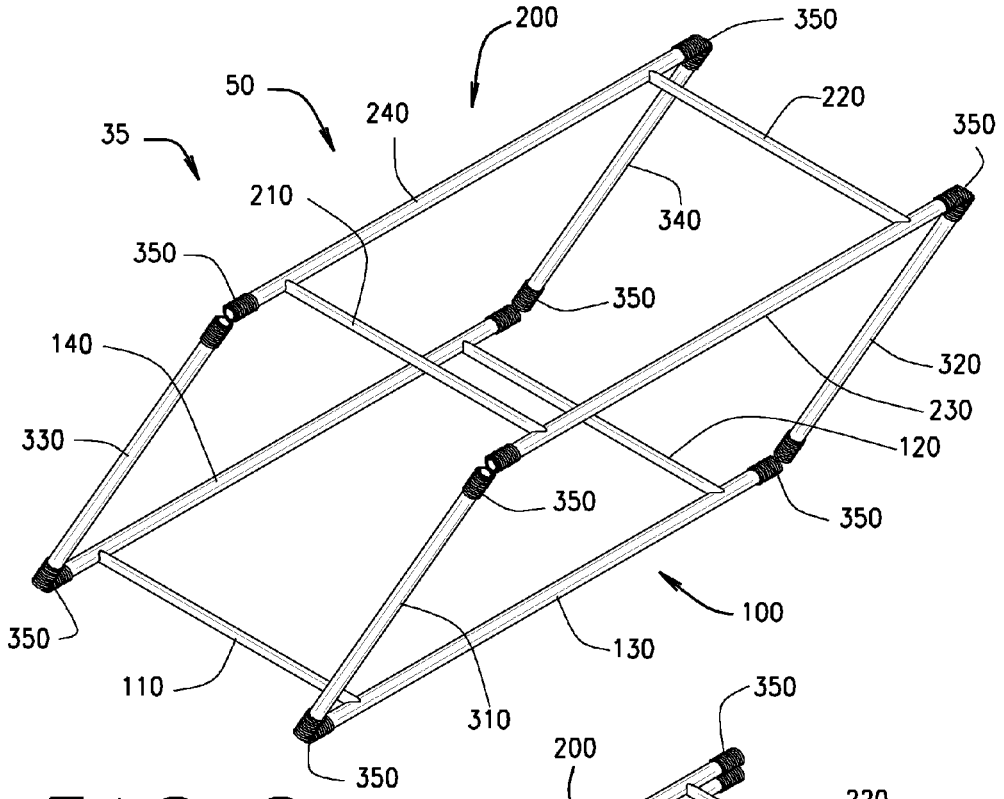
FIG. 2 is a perspective view of the internal frame transitioning to the collapsed position.
Figure 3:
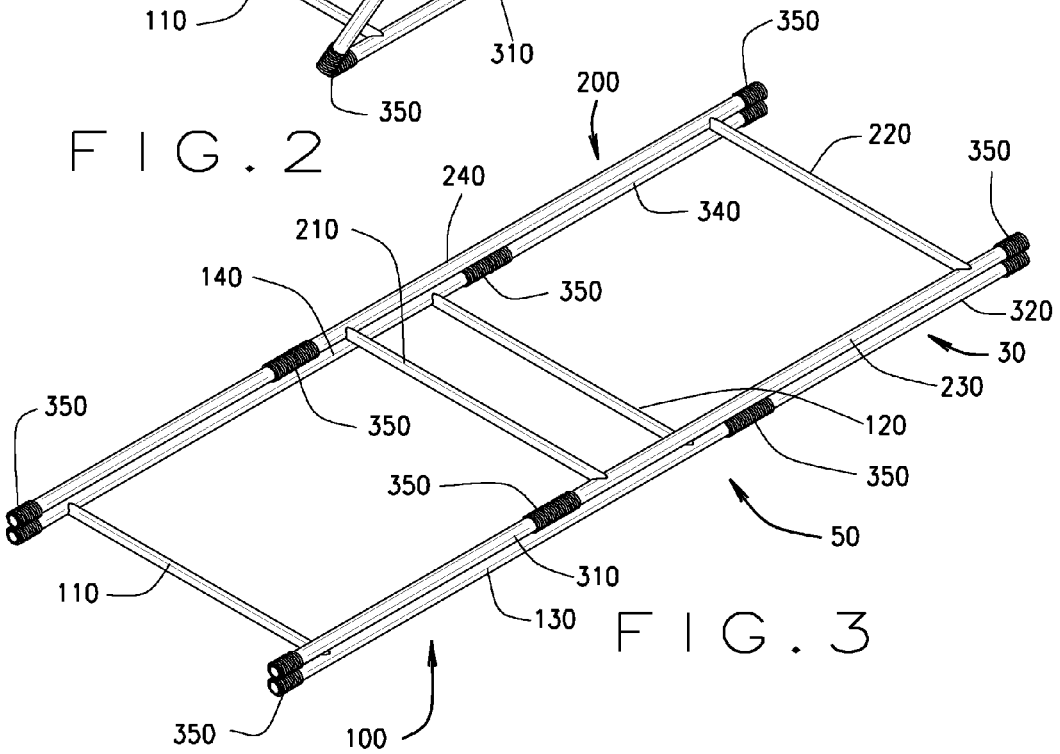
FIG. 3 is a perspective view of the internal frame in the collapsed position.
Figure 4:
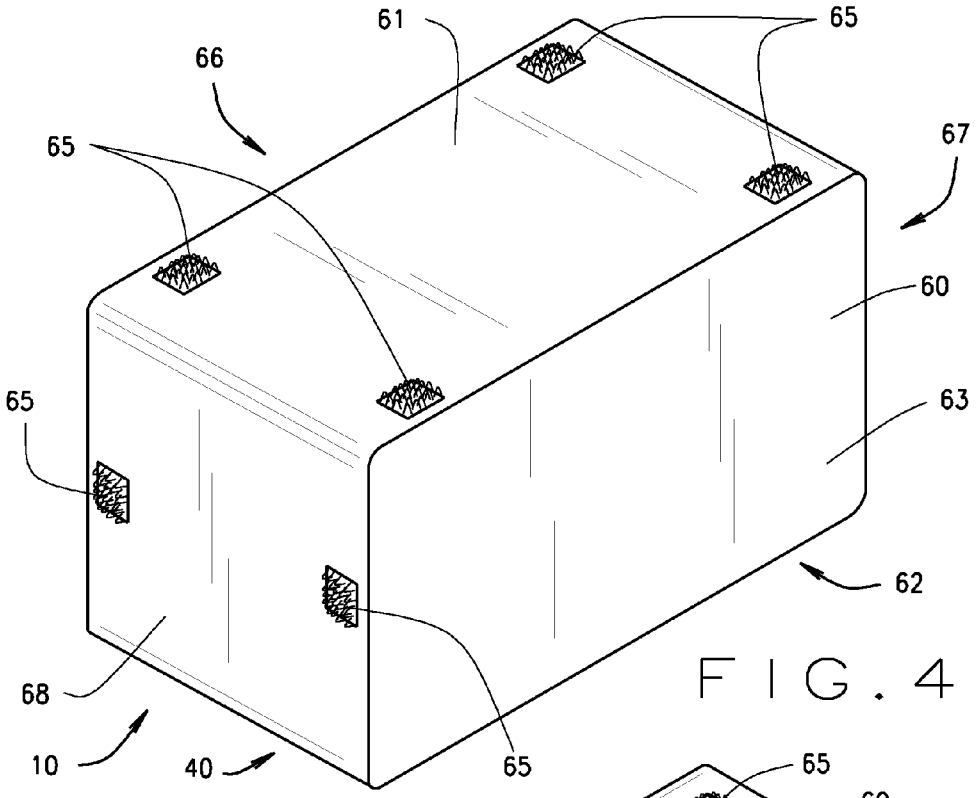
FIG. 4 is a perspective view of the toy block in the expanded position.
Figure 5:
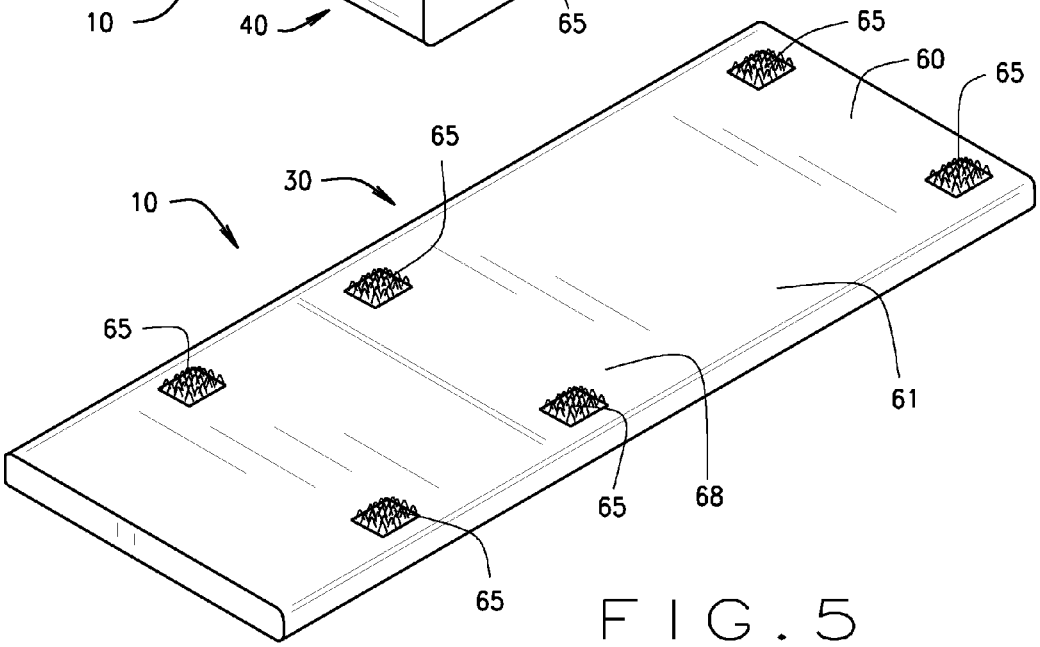
FIG. 5 is a perspective view of the toy block in the collapsed position.

A toy block 10 and a storage housing 500 will now be described with reference to FIGS. 1-12. The toy block 10 may be used to build toy structures 20, such as, for example, forts, playhouses, castles, etc. The toy block 10 readily converts from a collapsed position 30, such as shown in FIG. 5, to an expanded position 40, such as shown in FIG. 4. In the collapsed position 30, the toy block 10 has a significantly reduced volume compared to the expanded position 40. The collapsed position 30 provides a storage position for the toy block 10. In the collapsed position 30, the toy block 10 has a generally flat shape. This provides for convenient and efficient storage of the toy blocks 10.

The toy blocks 10 may readily convert from the collapsed position 30 to the expanded position 40 by releasing pressure on the toy blocks 10 by removing the toy blocks 10 from the storage housing 500 or by otherwise releasing any holding or closing force on the toy blocks 10. The toy blocks 10 will automatically spring or pop to the expanded position 40. An internal frame 50 of the toy block 10 assists in the automatic conversion to the expanded position 40.

With references to FIGS. 4 and 5, the internal frame 50 is provided with a cover 60. The cover 60 may be made of or include an elastic or resilient and stretchable material such as SPANDEX, LYCRA, or the like. The material for the cover 60 may also be breathable. The cover 60 generally covers the entire internal frame 50. The cover 60 may completely cover the entire internal frame 50 such that an interior of the toy block 10 is inaccessible. The elasticity of the cover 60 also directs the internal frame 50 to the expanded position 40. The cover 60 may be sewn, welded, or otherwise fastened about the internal frame 50. In certain aspects, portions of the cover 60 may be attached to the internal frame 50 such that cover 60 is maintained in a proper position on the internal frame 50. For example, the cover 60 may include internal loops that movingly connect to the internal frame 50. The loops may slide on the internal frame 50 as the internal frame 50 expands and collapses.

In the expanded position 40, the toy block 10 has a rectangular or square box shape with six generally flat and solid surfaces formed by the cover 60, including a top surface 61, a bottom surface 62, a front surface 63, a rear surface 66, a right surface 67, and a left surface 68. In the collapsed position 30, the overall length of the toy block 10 has been increased, which builds tension in portions of the cover 60. This tension helps spring the toy block 10 back to its expanded position 40.

The cover 60 may be provided with a plurality of fasteners 65, such as hook and loop fasteners, e.g., VELCRO, snaps, buttons, ties, etc., such that the blocks 10 may be removably attached or temporarily connected to other blocks 10. Although the fasteners 65 are shown on the left surface 68 and the top surface 61, the fasteners 65 may be positioned on any of the surfaces 61-68. The fasteners 65 assist in holding the toy blocks 10 together during the construction of forts, playhouses, and the like.

Figure 6:
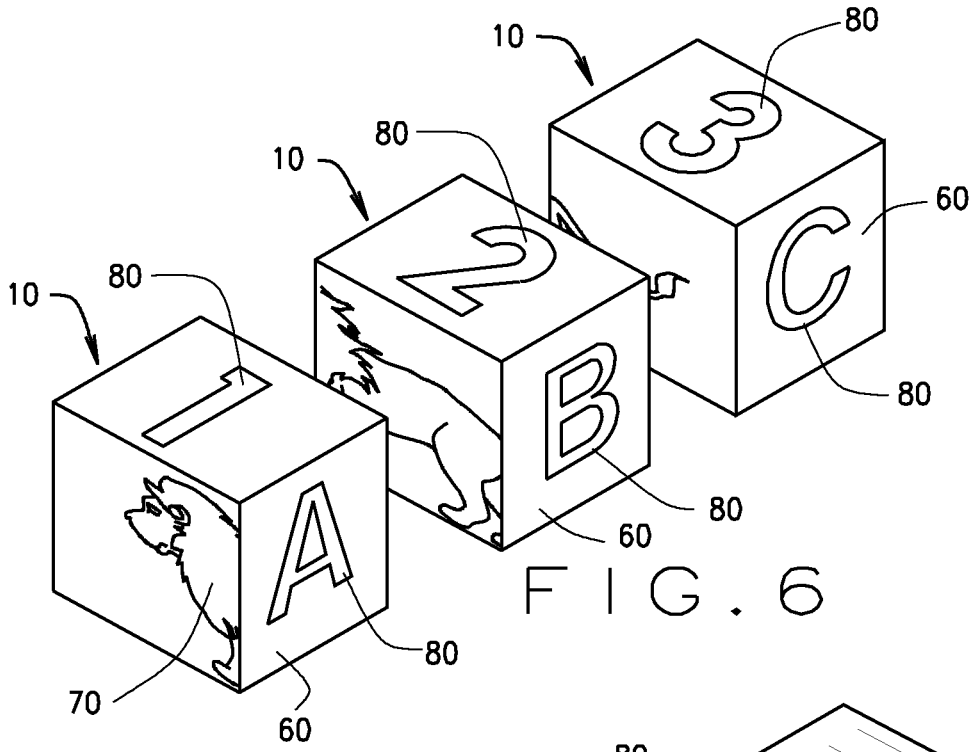
FIG. 6 is a view of the toy blocks with letters.

The cover 60 may include any of a variety of alpha or numeric characters 80 on any of its surfaces 61-68. With reference to FIG. 6, the characters 80 may be used to spell words or create numbered patterns, etc. The characters 80 may be used in conjunction with instructions for building specific play structures. For example, the instructions may direct the user to join a specific character 80 on one block 10 with another specific character 80 on another block 10 in order to construct a specific play structure 20.

Figure 7:
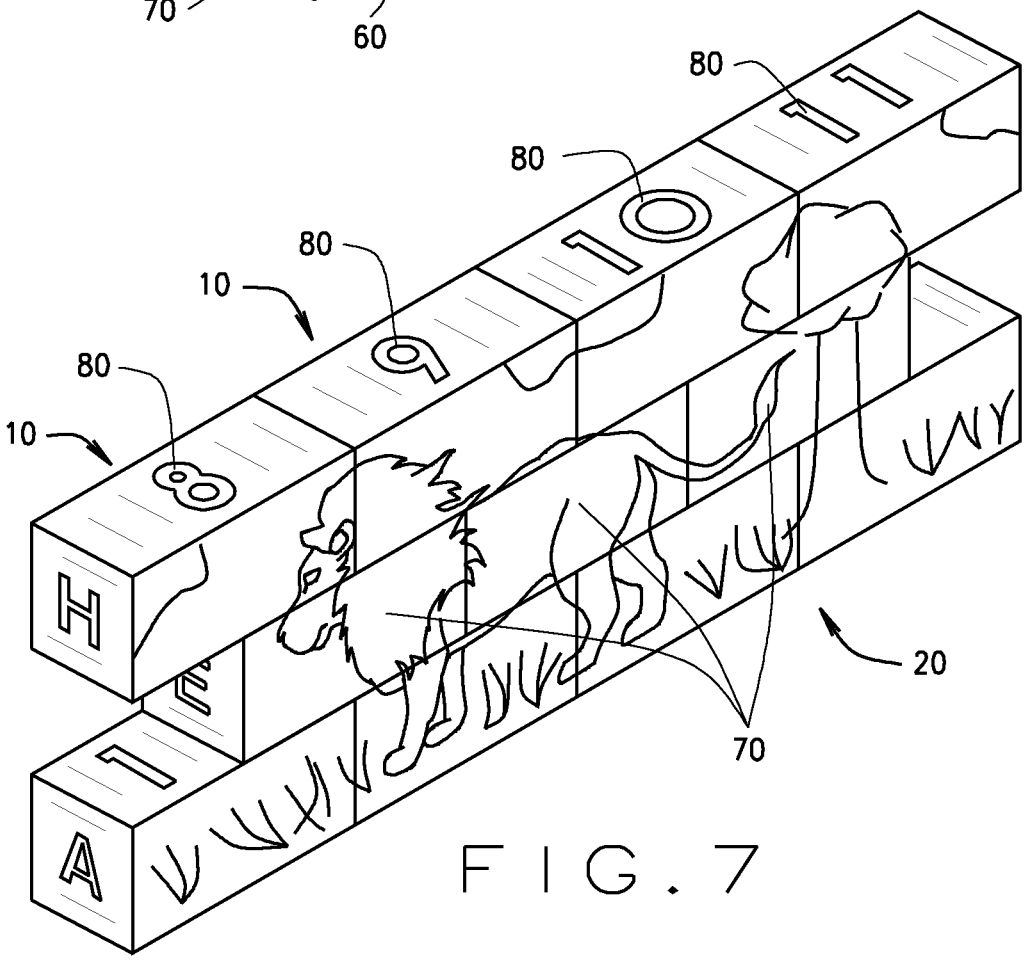
FIG. 7 is a view of the toy blocks forming a puzzle.

With reference to FIG. 7, the cover 60 may further include a variety of puzzle designs 70 on any of its surfaces 61-68. The puzzle designs 70 may include any of a variety of pictures, designs, portraits, landscapes, etc., such that the cover 60 of each block 10 has a different partial puzzle design 70 that when combined and properly aligned with other toy blocks 10 creates a completed puzzle design 70.

Figure 1:
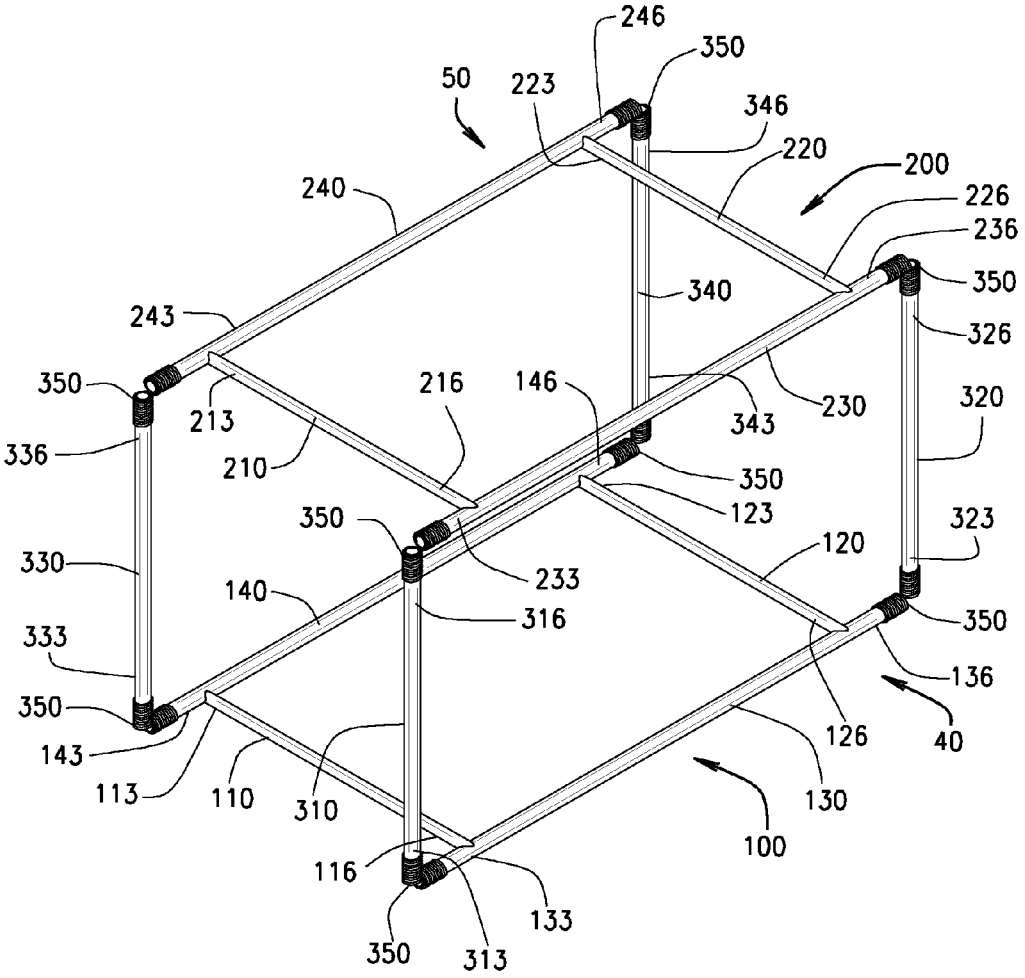
FIG. 1 is a perspective view of the internal frame in the expanded position.

With reference to FIG. 1, the internal frame 50 includes a first frame member 100 and a second frame member 200. The first frame member 100 and the second frame 200 are joined by a first vertical support 310, a second vertical support 320, a third vertical support 330, and a fourth vertical support 340. FIG. 1 shows the internal frame 50 in the expanded position 40. FIG. 2 shows the internal frame 50 in a partially collapsed position 35, and FIG. 3 shows the internal frame 50 in the collapsed position 30.

The first frame member 100 and the second frame member 200 generally have a rectangular or squared shape. The vertical supports 310, 320, 330, and 340 movably connect the first frame member 100 and the second frame member 200.

The first frame member 100 and the second frame member 200 are generally rigid to semi-rigid in structure. The frame members 100 and 200 and the vertical supports 310-340 may be made from plastic, wood, metal, composites, or other similar materials.

With reference to FIG. 1, the first frame member 100 includes a first horizontal support 110, a second horizontal support 120, a third horizontal support 130, and a fourth horizontal support 140. The first horizontal support 110 and the second horizontal support 120 are generally arranged in a parallel manner. Likewise, the third horizontal support 130 and the fourth horizontal support 140 are arranged in a generally parallel manner. The second frame member 200 is similarly constructed with a first horizontal support 210 generally parallel to a second horizontal support 220 and further with a third horizontal support 230 generally parallel to a fourth horizontal support 240.

A first end 113 of the first horizontal support 110 joins the fourth horizontal support 140, while a second end 116 of the first horizontal support 110 joins the a third horizontal support 130. A first end 123 of the second horizontal support 120 joins the fourth horizontal support 140, while a second end 126 of the second horizontal support 120 joins the third horizontal support 130. Similarly, a first end 213 of the first horizontal support 210 joins the fourth horizontal support 240, while a second end 216 of the first horizontal support 210 joins the a third horizontal support 230. A first end 223 of the second horizontal support 220 joins the fourth horizontal support 240, while a second end 226 of the second horizontal support 220 joins the third horizontal support 230.

A first end 313 of the first vertical support 310 connects with a first end 133 of the third horizontal support 130. The first end 313 connects with the first end 133 via a biasing member 350. A second end 316 of the first vertical support 310 connects with a first end 233 of the third horizontal support 230 via the biasing member 350.

Similarly, the second, third, and fourth vertical supports 320, 330 and 340 connect the first frame member 100 and the second frame member 200 via additional biasing members 350. As such, a first end 323 of the second vertical support 320 connects with a second end 136 of the third horizontal support 130. A second end 326 of the second vertical support 320 connects with a second end 236 of the third horizontal support 230. A first end 333 of the third vertical support 330 connects with a first end 143 of the fourth horizontal support 140. A second end 336 of the third vertical support 330 connects with a first end 243 of the fourth horizontal support 240. A first end 343 of the fourth vertical support 340 connects with a second end 146 of the fourth horizontal support 140. A second end 346 of the fourth vertical support 340 connects with a second end 246 of the fourth horizontal support 240.

The vertical supports 310, 320, 330 and 340 generally rotate approximately 90 degrees when the toy block 10 moves from the expanded position 40 to the collapsed position 30. When collapsed, the second frame member 200 may rest upon the first frame member 100.

The biasing members 350 provide a biasing force that orients the vertical supports 310, 320, 330, and 340 generally perpendicular to the first frame member 100 and to the second frame member 200, which is the expanded position 40. The biasing members 350 also connect the vertical supports 310, 320, 330, and 340 to the first frame member 100 and to the second frame member 200. The biasing members 350 may include any of a variety of springs, elastic materials, bands, tensioners, etc. The biasing members 350 join the adjacent ends of the vertical supports 310, 320, 330, and 340 with the horizontal supports 110-240. A combination of the biasing members 350 and the elastic nature of the cover 60 urges the toy block 10 from the collapsed position 30 to the expanded position 40. The expanded position 40 is the resting or normal position of the toy block 10, while the collapsed position 30 is the tensioned or biased position. In the collapsed position 30, portions of the cover 60 are stretched and the tension provided by the cover 60 is stored. When a closing pressure is removed from the toy block 10 in the collapsed position 30, the toy block 10 pops to the expanded position 40. The closing pressure may be from the storage housing 500 or a user. Without the closing pressure, the toy block 10 automatically converts from the collapsed position 30 to the expanded position 40. This provides for rapid and efficient conversion of the toy blocks 10 from a storage shape to a block shape that is immediately ready for play. As such, even young children may pull the toy blocks 10 form the storage housing 500, and the toy blocks 10 will be ready for immediate play.

During the collapsing of the toy block 10, the toy block generally can only collapse in one plane. The toy block 10 may collapse approximately 90 degrees in either direction of the one plane. As such, the toy block 10 has an approximately 180 degree range of motion in the one plane. In the fully collapsed position 30, the second frame member 200 may rest upon the first frame member 100.

The toy block 10 may include additional horizontal and vertical supports to provide additional strength and integrity to the toy block 10.

Figure 8:
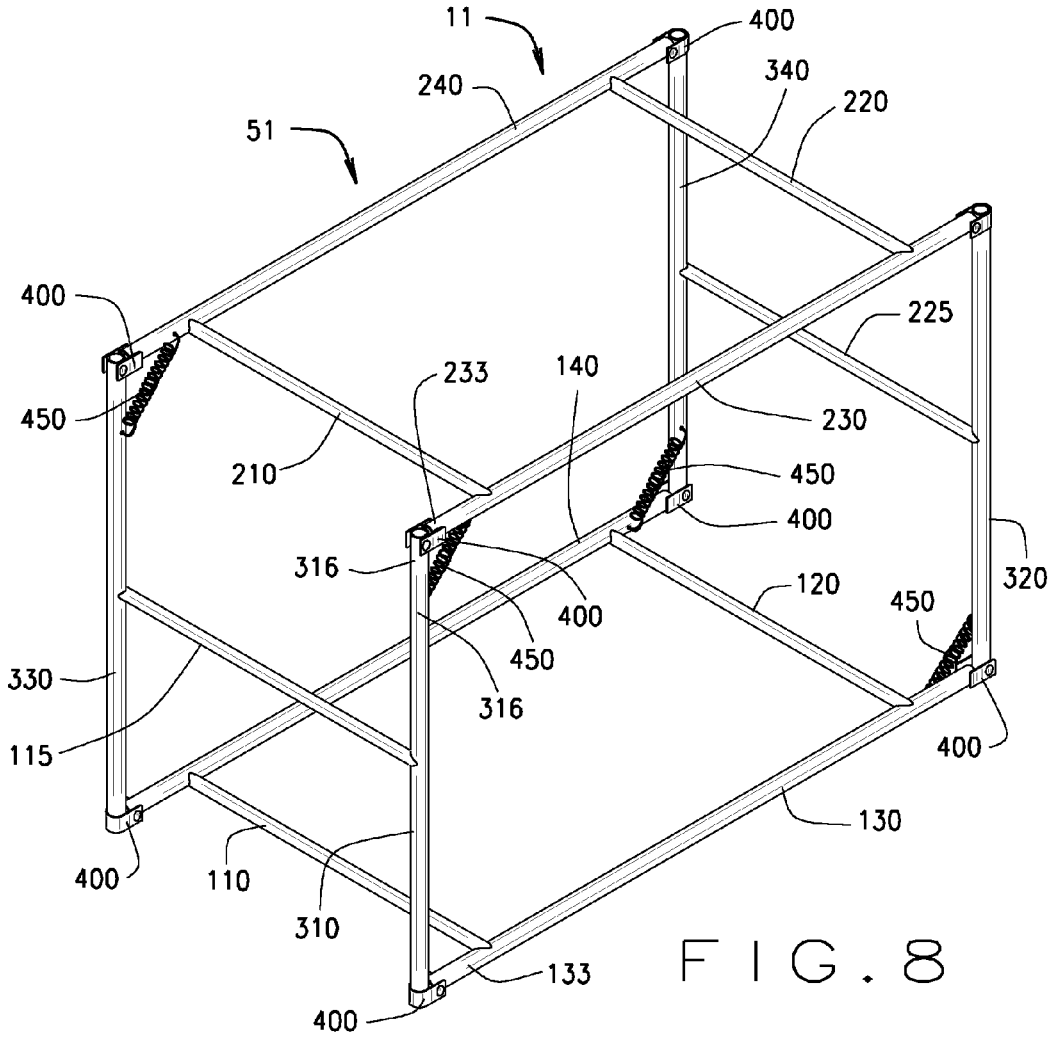
FIG. 8 is a perspective view of the internal frame with pivoting connections in the expanded position.
Figure 9:
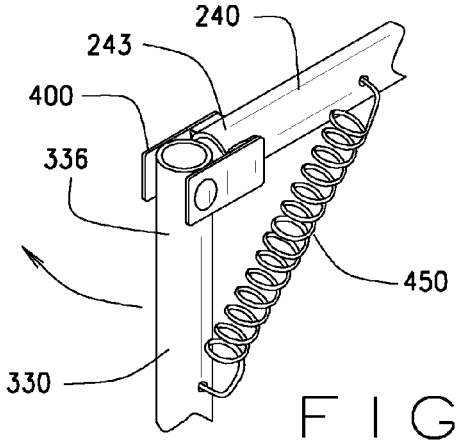
FIG. 9 is a view of the pivoting connection.
Figure 10:
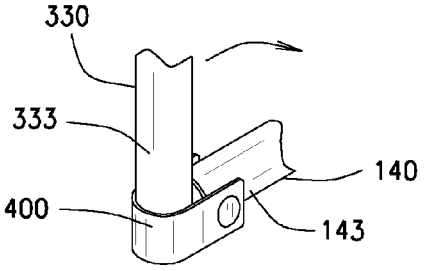
FIG. 10 is a further view of the pivoting connection.

In another aspect, a toy block 11 is shown with reference to FIGS. 8-10. The toy block 11 is shown with the cover 60 removed to show an internal frame 51. The toy block 11 includes a pivoting connection 400 between the vertical supports 310-340 and the horizontal supports 110-240. The toy block 11 further includes a biasing member 450 that joins the horizontal supports 110-240 with the vertical supports 310-340. Ends of the vertical supports 310, 320, 330, and 340 pivotally connect with ends of the first frame member 100 and the second frame member 200. The pivoting connection 400 provides approximately 90 degrees of rotation in one direction in one plane which allows the toy block 11 to collapse. The pivoting connection 400 may include an axle, a socket, a hinge, or other type of pivoting mechanical engagement. The biasing member 450 may include all types of springs, elastic materials, resilient bands, or other type of biasing mechanical engagements. The toy block 11 further incorporates horizontal supports 115 and 225 midway on the vertical supports 310, 320, 330, and 340.

Figure 11:
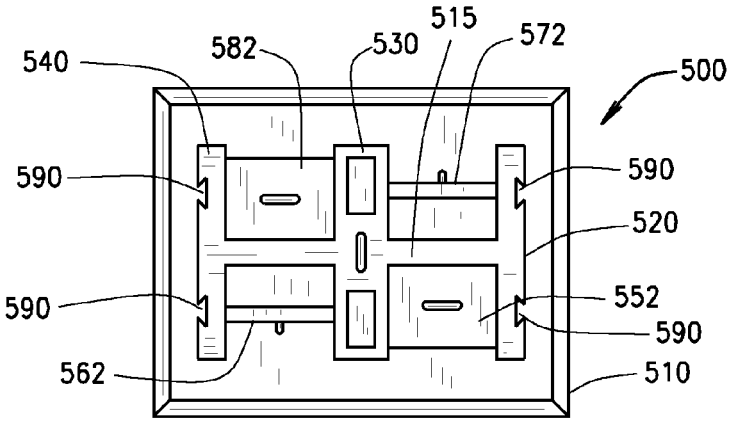
FIG. 11 is a top down view of the storage housing.
Figure 12:
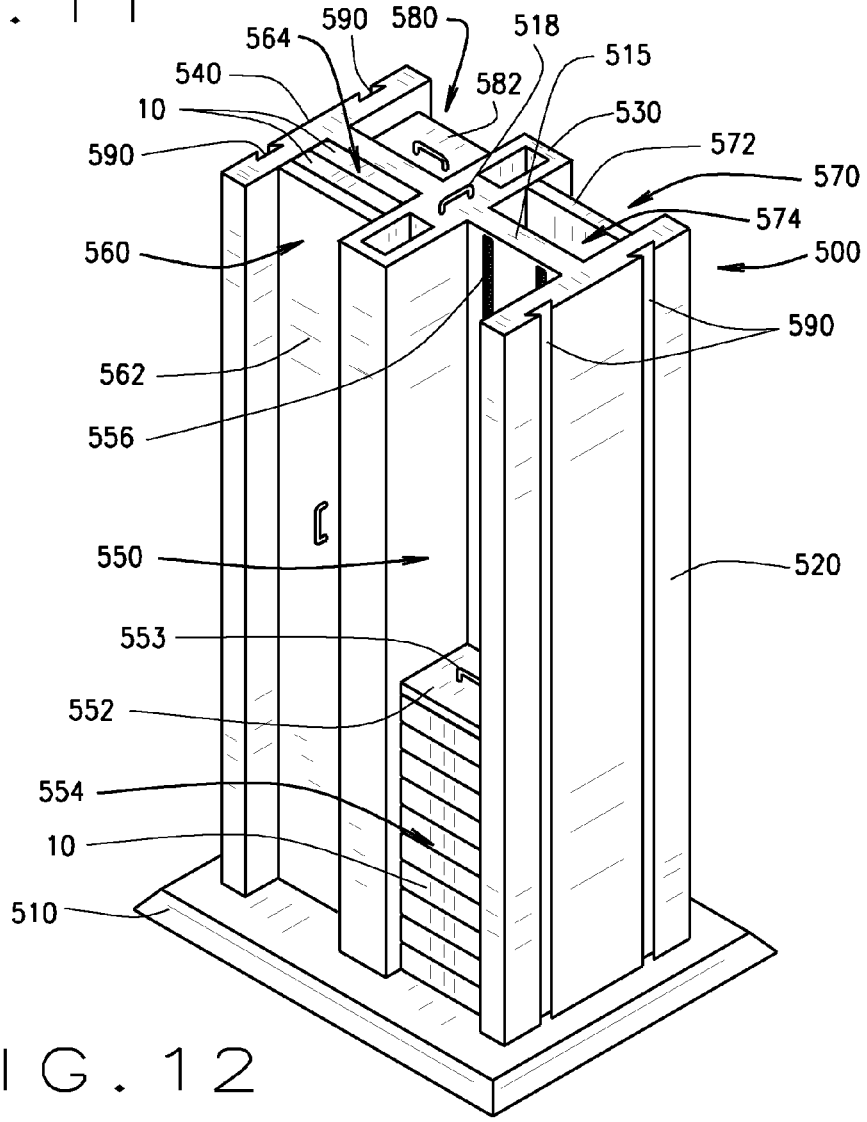
FIG. 12 is a perspective view of the storage housing.

The storage housing 500 will now be described with reference to FIGS. 11 and 12. FIG. 11 shows a top down view of the storage housing 500. FIG. 12 shows a perspective view of the storage housing 500.

The storage housing 500 includes a first outer wall 520, a middle wall 530, and a second outer wall 540 that join with a base 510 and an inner wall 515. The inner wall 515 generally extends vertically up from the base 510. The inner wall 515 further extends through a central portion of the storage housing 500 and connects the first outer wall 520, the middle wall 530, and the second outer wall 540. The inner wall 515 generally extends perpendicular to the first outer wall 520, the middle wall 530, and the second outer wall 540. A first storage section 550 is formed between the first outer wall 520, the middle wall 530, and the inner wall 515. A second storage section 560 is formed between the middle wall 530, the second outer wall 540, and the inner wall 515. Opposite of the first storage section 550 and the second storage section 560, a third storage section 570 is formed between the first outer wall 520, the middle wall 530, and the inner wall 515. Further, a fourth storage section 580 is formed between the middle wall 530, the second outer wall 540, and the inner wall 515. The inner wall 515 may be provided with a carrying handle 518. The inner wall 515 generally forms the inner, rear surface of the storage sections 550, 560, 570, and 580.

The first storage section 550 defines a storage area 554. The first storage section 550 holds one or more toy blocks 10 in the storage area 554. A first movable plate 552 is mounted on a biased track 556 of the inner wall 515. The first movable plate 552 is urged by the biased track 556 in a downward direction or generally parallel to a central axis of the storage housing 500. The first movable plate 552 compresses one or more toy blocks 10 in the storage area 554. The first movable plate 552 includes a handle 553.

The second storage section 560 includes a second movable plate 562 that moves inward, via a biased track, towards a central portion of the storage housing 500. The second storage section 560 defines a second storage area 564. The second movable plate 562 moves generally perpendicular to the central axis of the storage housing 500. The second storage section 560 may house or store toy blocks 10 having a different shape than the toy blocks 10 that are stored in the first storage section 550.

The third storage section 570 includes a third movable plate 572 and defines a third storage area 574. The fourth storage section 580 includes a fourth movable plate 582. The third and fourth movable plates 572 and 582 may compress additional toy blocks 10 in the third and fourth storage sections 570 and 580, respectively. Additional movable plates may be joined with the storage housing 500 via connections 590 to provide additional storage for additional toy blocks 10. The movable plates 552, 562, 572, and 582 of the storage housing 500 hold the collapsed toy blocks 10 in place in the storage housing 500. The movable plates 552, 562, 572, and 582 compress the toy blocks 10 to maintain the toy blocks 10 in the collapsed position 30.

The toy blocks 10 may form a variety of sizes and shapes including squares and rectangles. The toy blocks 10 may have a size of, for example, approximately 6 inches to approximately 36 inches in width and a size of, for example, approximately 6 inches to approximately 48 inches in length to provide a size for the toy blocks 10 that is suitable to build forts and play structures of a sufficient size that the children may actually play within or inside of the fort or play structure. The size of toy blocks 10 may further may be scaled up and down for further applications.

The storage housing 500 may be designed to store multiple different sizes of blocks 10. As such, the storage housing 500 may store in one section a block 10 having a first size, while storing additional blocks 10 having a second size in another section.

It should be understood from the foregoing that, while particular embodiments of the invention have been illustrated and described, various modifications can be made thereto without departing from the spirit and scope of the present invention. Therefore, it is not intended that the invention be limited by the specification; instead, the scope of the present invention is intended to be limited only by the appended claims.

What is claimed:

1. A toy block play system, comprising:

a plurality of toy blocks, wherein the toy blocks comprise a collapsed position and an expanded position;

a storage unit to store the plurality of toy blocks, the storage unit comprises a first storage section and a second storage section;

wherein the first storage section comprise a first compression plate to hold the toy blocks in the first storage section; and, wherein the second storage section comprise a second compression plate to hold the toy blocks in the second storage section.

2. The toy block play system according to claim 1, wherein the storage unit comprises a base, a first outer wall, a middle wall, a second outer wall, and inner wall, wherein the first storage section is formed between the first outer wall, the middle wall, and the inner wall, and the second storage section is formed between the second outer wall, the middle wall, and the inner wall.

3. The toy block play system according to claim 1, wherein the first compression plate moves generally parallel to a central axis of the storage unit, and the second compression plate moves generally perpendicular to the central axis of the storage unit.

4. The toy block play system according to claim 1, wherein the first compression plate and the second compression plates are mounted on spring biased tracks.

5. The toy block play system according to claim 4, wherein the first movable plate is urged by the biased track in a downward direction.

6. The toy block play system according to claim 4, wherein the first movable plate is urged generally parallel to a central axis of the storage unit.

7. The toy block play system according to claim 4, wherein the second movable plate moves inward, by the biased track, towards a central portion of the storage unit.

8. The toy block play system according to claim 4, wherein the second movable plate moves generally perpendicular to a central axis of the storage unit.

9. The toy block play system according to claim 4, wherein the first and second movable plates move in different directions.

10. The toy block play system according to claim 1, wherein the storage unit comprises a base, a first outer wall, a middle wall, a second outer wall, and inner wall, wherein the first storage section is formed between the first outer wall, the middle wall, and the inner wall, and the second storage section is formed between the second outer wall, the middle wall, and the inner wall, wherein the inner wall generally extends vertically up from the base, and the inner wall extends through central portion of the storage housing and connects the first outer wall, the middle wall and the second outer wall.

11. The toy block play system according to claim 10, wherein the inner wall generally extends perpendicular to the first outer wall, the middle wall, and the second outer wall.

12. The toy block play system according to claim 10, wherein the first storage section is formed between the first outer wall, the middle wall, and the inner wall.

13. The toy block play system according to claim 10, wherein the second storage section is formed between the middle wall, the second outer wall, and the inner wall.

14. The toy block play system according to claim 10, wherein the inner wall generally forms the inner, rear surface of the first and second storage sections.

15. The toy block play system according to claim 1, wherein the first movable plate compresses one or more toy blocks in the first storage section.

16. The toy block play system according to claim 15, wherein the second movable plate compresses one or more toy blocks in the second storage section.

17. The toy block play system according to claim 1, wherein the first movable plate is urged downward and generally parallel to a central axis of the storage unit by a first spring loaded track, and the second movable plate moves inward and generally perpendicular to the central axis of the storage unit by a second spring loaded track.

18. The toy block play system according to claim 1, wherein the first storage section holds toy blocks of a first size, and wherein the second storage section holds additional toy blocks of a second size.

19. The toy block play system according to claim 1, further comprising a third storage section and a fourth storage section.

20. A toy block play system, comprising:

a plurality of toy blocks, wherein the toy blocks comprise a collapsed position and an expanded position;

a storage unit to store the plurality of toy blocks, the storage unit comprises a first storage section, a second storage section, a third storage section, and a fourth storage section;

the first storage section comprise a first compression plate to hold the toy blocks in the first storage section;

the second storage section comprise a second compression plate to hold the toy blocks in the second storage section;

the third storage section comprise a third compression plate to hold the toy blocks in the third storage section.

the fourth storage section comprise a fourth compression plate to hold the toy blocks in the fourth storage section.

21. A toy block storage system, comprising:

a plurality of toy blocks, wherein the toy blocks comprise a collapsed position and an expanded position;

a storage unit to store the plurality of toy blocks, the storage unit comprises a first storage section and a second storage section;

the first storage section comprises a first compression plate to hold the toy blocks in the first storage section; and, the second storage section comprises a second compression plate to hold the toy blocks in the second storage section.

the first compression plate and the second compression plates are mounted on spring biased tracks.

22. A toy block play system, comprising:

a plurality of toy blocks, wherein the toy blocks comprise a flattened position and an expanded position, and the toy blocks automatically convert from the flattened position to the expanded position, and the toy blocks convert from the expanded position back to the flattened position;

a storage unit to store the plurality of toy blocks, the storage unit comprises a first storage section and a second storage section;

wherein the storage unit maintains the toy blocks in the flattened position in the first storage section; and, wherein the storage unit maintains the toy blocks in the flattened position in the second storage section.

23. The toy block play system according to claim 22, wherein the first storage section holds toy blocks of a first size, and wherein the second storage section holds additional toy blocks of a second size.

24. The toy block play system according to claim 22, further comprising a third storage section and a fourth storage section.

* * * * *